US006243902B1

(12) United States Patent
Huang

(10) Patent No.: US 6,243,902 B1
(45) Date of Patent: Jun. 12, 2001

(54) TOOL HANDLE COMBINATION

(76) Inventor: Yung Hsu Huang, No. 10, Lane 38, Li Der Street, Taiping City, Taichung Hsien (TW)

( * ) Notice: Subject to any disclaimer, the term of this patent is extended or adjusted under 35 U.S.C. 154(b) by 0 days.

(21) Appl. No.: 09/414,575

(22) Filed: Oct. 8, 1999

(51) Int. Cl.[7] ..... B25B 23/16
(52) U.S. Cl. ..... 7/165; 81/177.4; 81/490
(58) Field of Search ..... 7/165; 81/177.4, 81/490

(56) References Cited

U.S. PATENT DOCUMENTS 4,930,377 * 6/1990 Lester ..... 7/165 X
5,704,260 1/1998 Huang .
5,735,005 * 4/1998 Wang ..... 7/165 X
5,782,150 7/1998 Huang .
5,887,306 * 3/1999 Huang ..... 7/165
5,896,606 4/1999 Huang .

* cited by examiner

*Primary Examiner*—James G. Smith
(74) *Attorney, Agent, or Firm*—Charles E. Baxley, Esq.

(57) ABSTRACT

A tool handle device includes a handle having a base and a cover pivotally secured to the base for enclosing the interior of the base. The cover includes one or more retainers for securing tool members to the handle. The base includes one or more spaces for receiving the tool members and a tool, such as a plier device, particularly a foldably plier device. The handle includes two end pieces, the base is secured between the end pieces. An opening is formed between the end pieces for receiving the cover. A block is secured to a driving stem for receiving tool bits.

6 Claims, 3 Drawing Sheets

TOOL HANDLE COMBINATION

BACKGROUND OF THE INVENTION

1. Field of the Invention

The present invention relates to a handle, and more particularly to a tool handle combination.

2. Description of the Prior Art

The applicant has developed various kinds of tool handles. Three of which have been issued as U.S. Pat. No. 5,704,260 to Huang, and U.S. Pat. No. 5,782,150 to Huang, and U.S. Pat. No. 5,896,606 to Huang. The tool handles may be used for receiving the tool bits and sockets only, but have no space for receiving the other tools, such as the plier device.

The present invention has arisen to mitigate and/or obviate the afore-described disadvantages of the conventional tool handles.

SUMMARY OF THE INVENTION

The primary objective of the present invention is to provide a tool handle combination including a space formed therein for receiving a plier device and including one or more sockets and/or one or more tool bits received therein.

In accordance with one aspect of the invention, there is provided a tool handle combination comprising a handle body including a base including an interior provided therein and a cover pivotally secured to the base for enclosing the interior of the base, at least one tool member, means for retaining the tool member in the handle body, and a tool received in the interior of the base.

The base includes a partition provided therein for separating the interior of the base into a first space and a second space for receiving the tool member and the tool respectively. The base includes a latch orifice formed therein, the cover includes a latch for engaging into the latch orifice of the base and for securing the cover to the base.

The handle body includes two end pieces, the base is secured between the end pieces of the handle body and includes a size smaller than that of the end pieces of the handle body for defining an opening between the end pieces of the handle body and for receiving the cover.

The cover includes at least one hole formed therein, the base includes at least one projection extended therefrom for engaging into the hole of the cover and for securing the cover to the base. The retaining means includes at least one retainer provided in the cover for securing and holding the tool member.

The tool may be a plier device, and preferably a foldable plier device. A driving stem is further attached to the handle body, and a block is secured on the driving stem and includes at least one aperture formed therein for receiving the tool member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
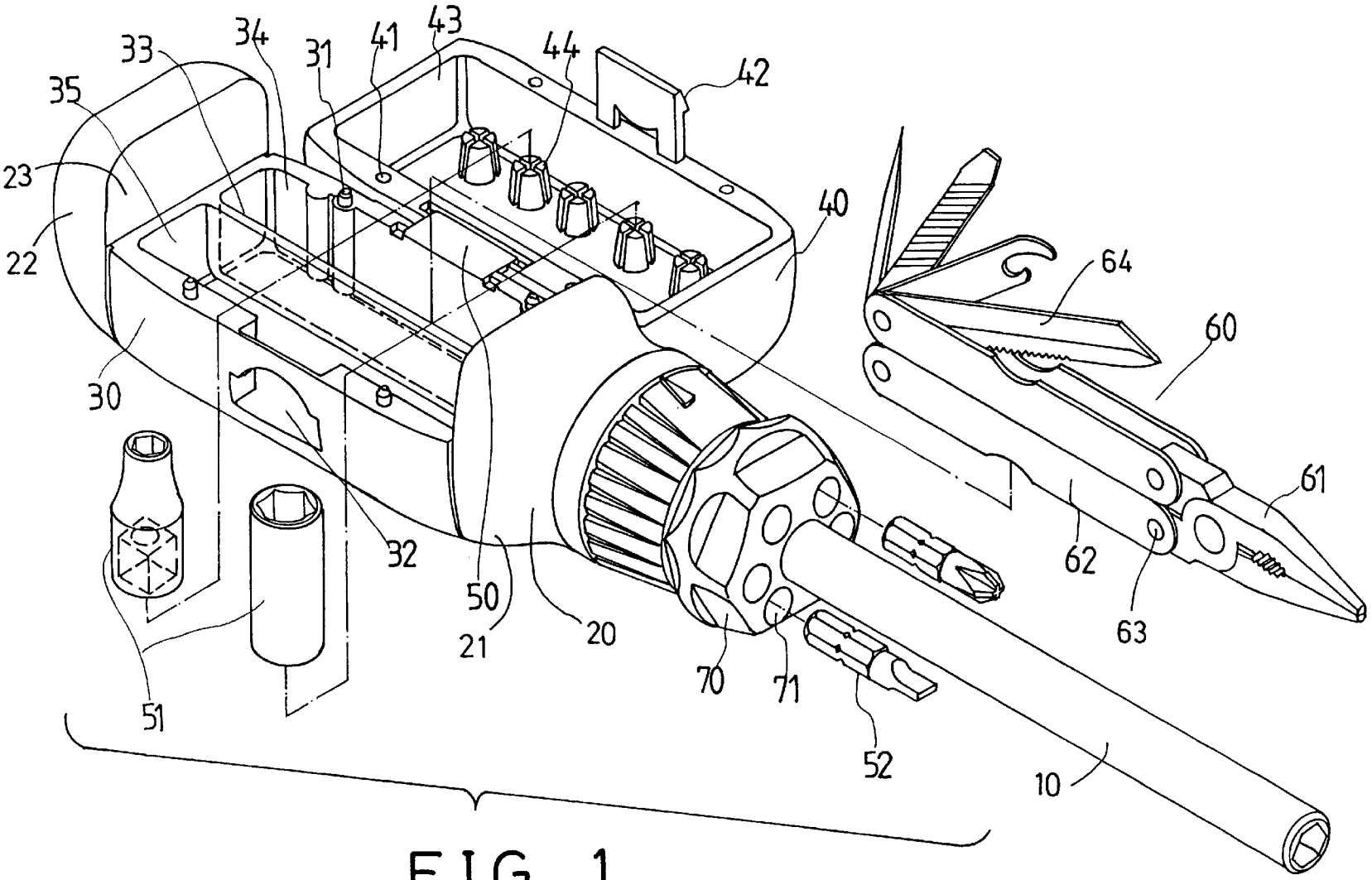
FIG. 1 is an exploded view of a tool handle combination in accordance with the present invention.
Figure 2:
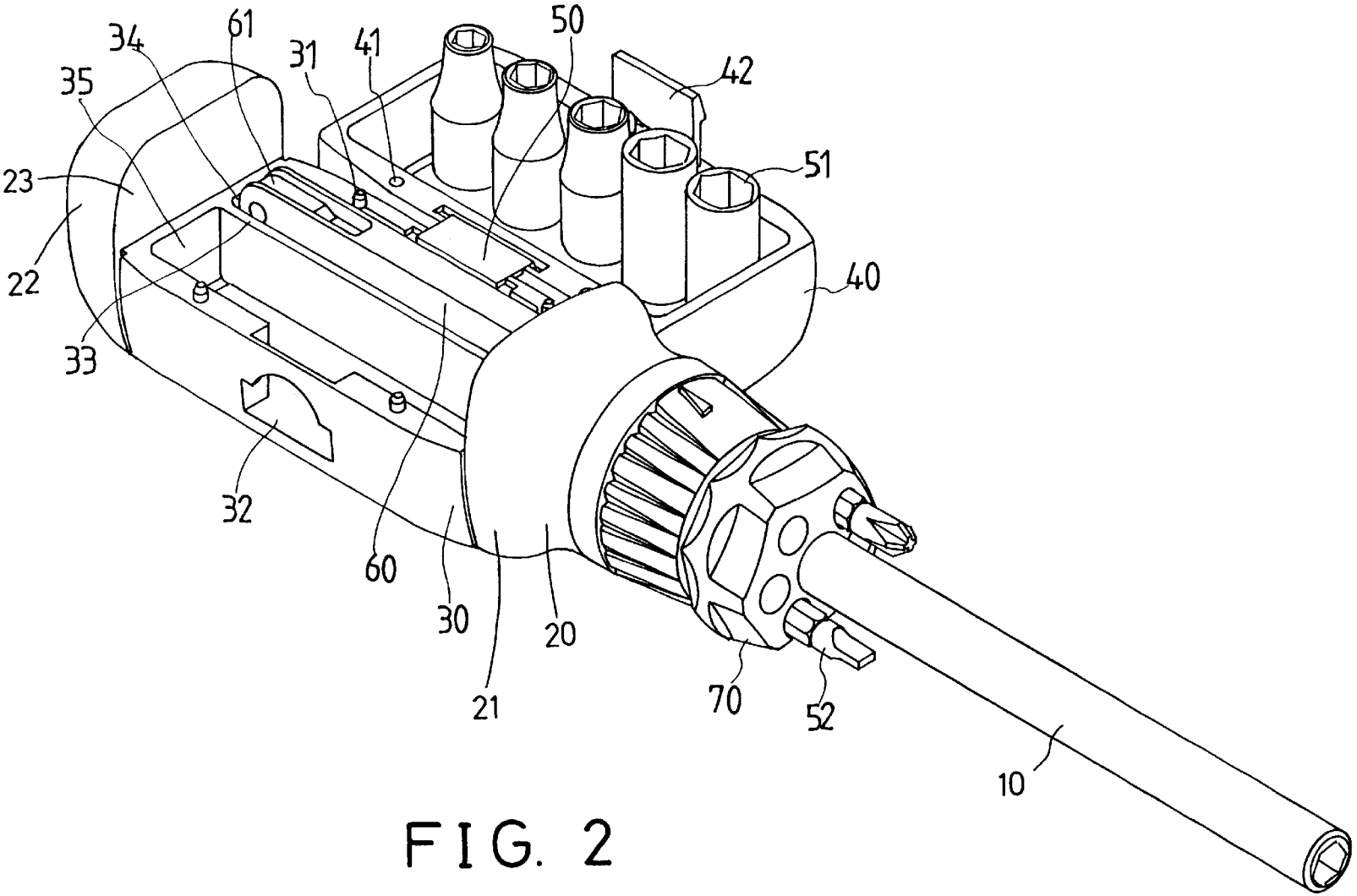
FIG. 2 is a perspective view of the tool handle combination.

Referring to the drawings, and initially to FIGS. 1 and 2, a tool handle combination in accordance with the present invention comprises a driving stem 10 secured or attached to a handle body 20 for driving fasteners directly or via tool bits 52 or via tool extensions and sockets 51. The handle 20 includes a base 30 secured between two end pieces 21, 22, particularly between the front end piece 21 and the rear end piece 22 of the handle body 20. The base 30 includes a size or a depth less than that of the end pieces 21, 22 such that an opening 23 is formed above the base 30 and formed between the end pieces 21, 22 for receiving a cover 40. The base 30 includes one or more projections 31 extended upward therefrom, and includes a partition 33 provided therein for separating the interior of the base 30 into two spaces 34, 35. The base 30 includes a latch orifice 32 formed therein.

Figure 3:
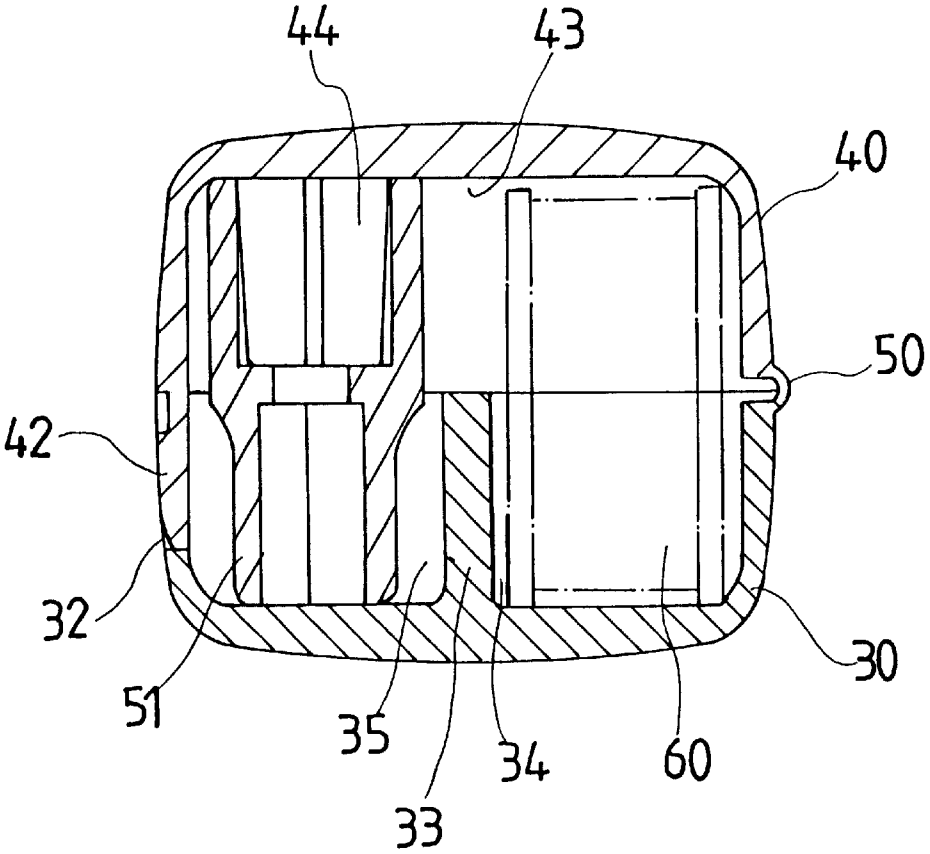
FIG. 3 is a cross sectional view of the tool handle combination, in which the cover of the handle is disposed in an enclosed position.

The cover 40 is pivotally coupled to the base 30 at a pivot shaft or a live hinge 50 for allowing the cover 40 to be disengaged and separated from the base 30 at an open position as shown in FIGS. 1 and 2, and to be engaged into the opening 23 of the handle body 20 and engaged with the base 30 at an enclosed position as shown in FIG. 3. The cover 40 includes one or more holes 41 formed therein for receiving the projections 31 of the base 30 and for securing the cover 40 to the base 30, and includes a latch 42 engaged into the latch orifice 32 of the base 30 for solidly securing the cover 40 to the base 30. The cover 40 includes a chamber 43 formed therein and includes one or more retainers 44 provided therein and/or having various kinds of structures for securing the tool bits or the sockets 51 to the cover 40. The sockets 51 are received in the space 35 of the base 30 (FIG. 3) when the cover 40 is engaged onto the base 30.

A tool, such as a plier device 60, particularly a foldably plier device 60 is further provided and includes a pair of hand grips 62 pivotally secured to a pair of jaws 61 at a pivot pin 63 respectively for allowing the plier device 60 to be folded to a compact configuration and to be engaged into the space 34 of the base 30. The plier device 60 may further include one or more tool elements 64 pivotally secured thereto. The plier device 60 includes one half, or the lower portion engaged in the space 34 of the base 30 and includes the other half, or the upper portion received in the chamber 43 of the cover 40. The provision of the plier device 60 greatly increases the function of the tool handle combination that may not be reached by the typical tool handles. The tool handle combination further includes a block 70 engaged onto and secured to the driving stem 10 and/or the handle body 20 with such as a force-fitted engagement. The block 70 includes one or more apertures 71 formed therein for receiving the tool bits 52. Accordingly, the tool handle combination includes one or more sockets 51, and one or more tool bits 52, and a tool 60, such that the function of the tool handle combination may be greatly increased.

It is to be noted that, without the partition 33 of the base 30, the tool 60 may also be retained in the handle body 20 by the cover 40 and/or the sockets 51. The retainers 44 may also be provided in the base 30 for securing the tool members, such as the sockets 51 or the tool bits 52 in the base 30.

Accordingly, the tool handle combination in accordance with the present invention includes a space formed therein for receiving a plier device and including one or more sockets and/or one or more tool bits received therein.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handle combination comprising:

a) a handle body including:

i) a base including an interior provided therein, and ii) a cover pivotally secured to said base for enclosing said interior of said base, b) at least one tool member, c) means for retaining said at least one tool member in said handle body, and d) a plier device received in said interior of said base.

2. The tool handle combination according to claim 1, wherein said base includes a partition provided therein for separating said interior of said base into a first space and a second space for receiving said at least one tool member and said plier device respectively.

3. The tool handle combination according to claim 1, wherein said base includes a latch orifice formed therein, said cover includes a latch for engaging into said latch orifice of said base and for securing said cover to said base.

4. The tool handle combination according to claim 1, wherein said cover includes at least one hole formed therein, said base includes at least one projection extended therefrom for engaging into said at least one hole of said cover and for securing said cover to said base.

5. The tool handle combination according to claim 1, wherein said retaining means includes at least one retainer provided in said cover for securing and holding said at least one tool member.

6. The tool handle combination according to claim 1, wherein said plier device is a foldable plier device.

* * * * *